US008387515B2

(12) United States Patent
Ikari et al.

(10) Patent No.: US 8,387,515 B2
(45) Date of Patent: Mar. 5, 2013

(54) FLUID PRESSURE CYLINDER WITH TRUNNION SUPPORT FITTING

(75) Inventors: Tetsuya Ikari, Moriya (JP); Makoto Yaegashi, Irvine, CA (US)

(73) Assignee: SMC Kabushiki Kaisha, Tokyo (JP)

( * ) Notice: Subject to any disclaimer, the term of this patent is extended or adjusted under 35 U.S.C. 154(b) by 1009 days.

(21) Appl. No.: 12/443,702

(22) PCT Filed: Dec. 15, 2006

(86) PCT No.: PCT/JP2006/325109

§ 371 (c)(1),
(2), (4) Date: Mar. 31, 2009

(87) PCT Pub. No.: WO2008/047463

PCT Pub. Date: Apr. 24, 2008

(65) Prior Publication Data

US 2010/0005957 A1 Jan. 14, 2010

(30) Foreign Application Priority Data

Oct. 18, 2006 (JP) ..... 2006-283695

(51) Int. Cl.
*F01B 29/00* (2006.01)

(52) U.S. Cl. ..... 92/161; 92/169.1

(58) Field of Classification Search ..... 92/161, 92/169.1, 128, 88

See application file for complete search history.

(56) References Cited

U.S. PATENT DOCUMENTS

| | | | | |
|---|---|---|---|---|
| 4,700,616 | A * | 10/1987 | Stoll et al. | 92/118 |
| 5,048,157 | A | 9/1991 | Wehrli | |
| 5,237,909 | A * | 8/1993 | Pirhadi | 92/161 |
| 5,477,774 | A * | 12/1995 | Ikumi | 92/161 |
| 7,032,501 | B2 * | 4/2006 | Boertje et al. | 92/161 |
| 2003/0087097 | A1 * | 5/2003 | Lukschandel et al. | 428/408 |

FOREIGN PATENT DOCUMENTS

| | | |
|---|---|---|
| JP | 51 15564 | 2/1976 |
| JP | 57 165164 | 10/1982 |
| JP | 61 256005 | 11/1986 |
| JP | 61 193204 | 12/1986 |
| JP | 62 72905 | 4/1987 |
| JP | 2 68317 | 3/1990 |
| JP | 5 500550 | 2/1993 |
| JP | 5 64670 | 3/1993 |
| JP | 6 114128 | 4/1994 |
| JP | 2001-90710 | 4/2001 |
| JP | 2003 232307 | 8/2003 |
| JP | 2006-250288 | 9/2006 |

OTHER PUBLICATIONS

Extended European Search Report issued Jun. 28, 2011, in Patent Application No. 06834836.6.

* cited by examiner

*Primary Examiner* — Thomas E Lazo
*Assistant Examiner* — Logan Kraft
(74) *Attorney, Agent, or Firm* — Oblon, Spivak, McClelland, Maier & Neustadt, L.L.P.

(57) ABSTRACT

A pair of trunnion support fittings is installed on a cylinder tube, and the trunnion support fittings have main fittings placed along vertical outer surfaces of the cylinder tube and also have fastening fittings connected to arm sections of the main fittings by screws. Installation projections formed on the fastening fittings are engaged with engagement grooves formed in lateral outer surfaces of the cylinder tube. Also, particle layers are formed on the trunnion support fittings and are in contact with the vertical outer surfaces and lateral outer surfaces of the cylinder tube.

10 Claims, 10 Drawing Sheets

FLUID PRESSURE CYLINDER WITH TRUNNION SUPPORT FITTING

TECHNICAL FIELD

The present invention relates to a fluid pressure cylinder equipped with a trunnion support fitting attached to various types of industrial equipment and used for performing machining on products or for transporting products, or the like, and more specifically to a fluid pressure cylinder equipped with trunnion support fitting by which the fluid pressure cylinder is swingwably mounted at a predetermined position.

BACKGROUND ART

Heretofore, in various types of industrial equipment, a fluid pressure cylinder, which performs machining on products or transports products and the like, is swingably mounted at a predetermined position by a trunnion support fitting.

In a fluid pressure cylinder 101 equipped with a trunnion support fitting 100 shown in FIGS. 9 and 10, as disclosed in Japanese Laid-Open Patent Publication No. 62-072905, two respective trunnion support fittings 100 having support shafts 103 are affixed to outer surfaces of a cylinder tube 102 having a substantially rectangular shape in cross section, whereby the support shafts 103 are supported swingably on bearing members 104.

With this type of fluid pressure cylinder 101, because work such as transporting or welding of products is performed while swinging movements about the support shafts 103 are repeatedly carried out, relative positional shifting in the direction of the L-axis easily occurs by swinging of the fluid pressure cylinder 101 and the trunnion support fittings 100. For this purpose, it is essential that the trunnion support fittings 100 be affixed firmly to the cylinder tube 102.

However, generally, with this type of cylinder tube 102, in relation to the attachment of a magnetic position sensor, which acts to detect the operative position of a piston, it is frequently the case that the cylinder tube 102 is formed from aluminum material which is non-magnetic metal. Because aluminum is comparatively soft, when the trunnion support fittings 100 are attached and tightened forcefully by means of screws or the like, there are cases in which warping and deformation on the cylinder tube 102 is generated at portions thereof where screws, latching projections, etc., are provided, thus exerting an adverse influence on operation of the fluid pressure cylinder 101.

DISCLOSURE OF THE INVENTION

A principal object of the present invention is to provide a fluid pressure cylinder equipped with a trunnion support fitting, which enables the trunnion support fitting to be reliably affixed, while suppressing deformations of the cylinder tube when the trunnion support fitting is mounted and attached thereto.

The present invention is a fluid pressure cylinder equipped with a trunnion support fitting, wherein a piston disposed inside a cylinder tube is displaced upon supply of a pressure fluid thereto, and comprising a pair of trunnion support fittings disposed on an outer surface of the cylinder tube for swingably supporting the fluid pressure cylinder on bearing members. Preferably, each of the trunnion support fittings comprises attachment projections, which engage within engagement grooves formed on the outer surface of the cylinder tube, and a particle layer for enhancing friction formed at a region that abuts with respect to the outer surface of the cylinder tube, wherein by engagement of the attachment projection in the engagement groove, the trunnion support fittings are mounted with respect to the cylinder tube, in a state such that the particle layer abuts against the outer surface of the cylinder tube.

Further, it is preferable for the particle layer to be formed respectively on inner surfaces of the trunnion support fittings that abut against the outer surface of the cylinder tube, as well as on the attachment projections that abut against groove walls of the engagement grooves.

Moreover, it is preferable for the cylinder tube to be formed with a substantially rectangular shape in cross section, having two opposing longitudinal outer surfaces and two other opposing lateral outer surfaces, and further having two of the engagement grooves extending in the axial direction of the cylinder tube, provided respectively on each of the longitudinal outer surfaces and the lateral outer surfaces.

Still further, each of the trunnion support fittings comprises a pair of main fittings, each of which is formed with a substantially U-shape in cross section, mounted along the longitudinal outer surfaces of the cylinder tube, wherein both end portions thereof extend respectively along the lateral outer surfaces, and a pair of fastening fittings provided on both end portions of the main fittings, which are disposed so as to confront the engagement grooves provided on the lateral outer surfaces. Preferably, two positioning projections, which are engaged in the two engagement grooves formed on the longitudinal outer surfaces, are formed on the main fittings, and attachment projections, which are engaged within the engagement grooves of the lateral outer surfaces, are formed on the fastening fittings, the pair of trunnion support fittings being attached at mutually confronting positions of the cylinder tube.

Still further, it is preferable for the particle layer on the inner surfaces of the trunnion support fitting to be formed on both of the main fittings and the fastening fittings.

Further, it is preferable for the fastening fittings to be formed apart from the main fittings, such that the fastening fittings are connected with respect to the main fittings by screws, so that the attachment projections become latched in the engagement grooves by tightening the screws.

Furthermore, it is preferable for a positioning pin to be stretched between one of the trunnion support fittings and another of the trunnion support fittings, such that the one trunnion support fitting and the other trunnion support fitting are mutually relatively positioned through the positioning pin.

Still further, the present invention is a fluid pressure cylinder equipped with a trunnion support fitting, wherein a piston disposed inside a cylinder tube is displaced upon supply of a pressure fluid thereto, and comprising trunnion support fittings disposed on an outer surface of the cylinder tube for swingably supporting the fluid pressure cylinder on bearing members. In addition, the trunnion support fittings comprise a pair of main fittings, each of which is formed with a substantially U-shape in cross section, mounted along longitudinal outer surfaces of the cylinder tube, and wherein both end portions thereof are disposed outwardly of flanges, which are formed on lateral outer surfaces of the cylinder tube, a pair of fastening fittings provided on both end portions of the main fittings, and which are disposed inwardly of the flanges, and screws that connect the main fittings and the fastening fittings. Preferably, the main fittings and the fastening fittings are arranged in confronting relation to each other while sandwiching the flanges therebetween, the flanges being gripped by tightening the screws.

Still further, it is preferable for the flanges to be provided in respective pairs on each of longitudinal outer surfaces and on other opposing lateral outer surfaces of the cylinder tube, which is formed with a substantially rectangular shape in cross section, wherein the flanges are formed so as to project outwardly with respect to the longitudinal side surfaces and the lateral side surfaces.

Further, it is preferable for the flanges to be disposed at positions outwardly with respect to an attachment groove of the cylinder tube, in which a detection sensor capable of detecting a displacement position of the piston is installed.

BEST MODE FOR CARRYING OUT THE INVENTION

Figure 1:
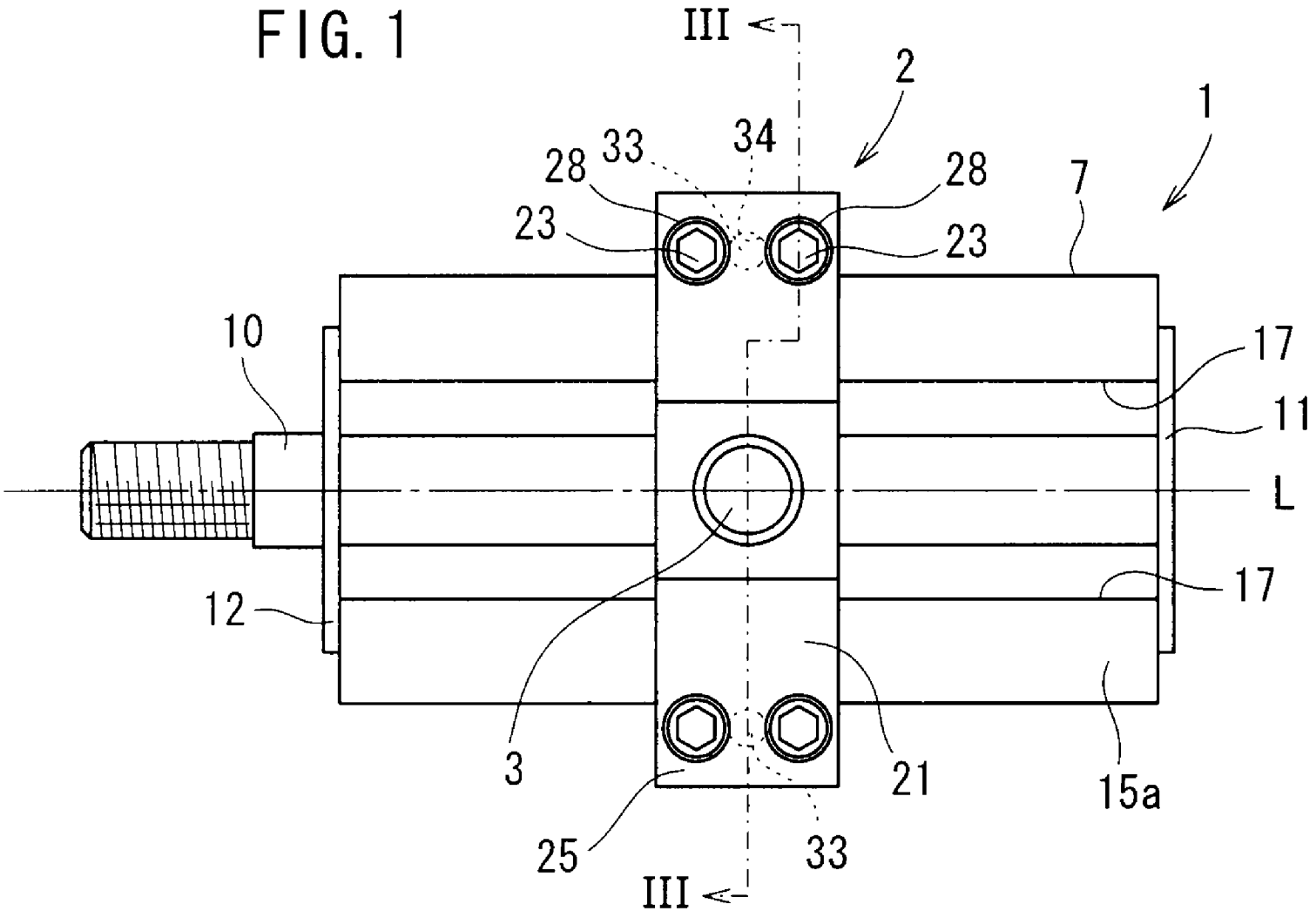
FIG. 1 is a frontal view showing a fluid pressure cylinder equipped with a trunnion support fitting according to a first embodiment of the present invention.
Figure 2:
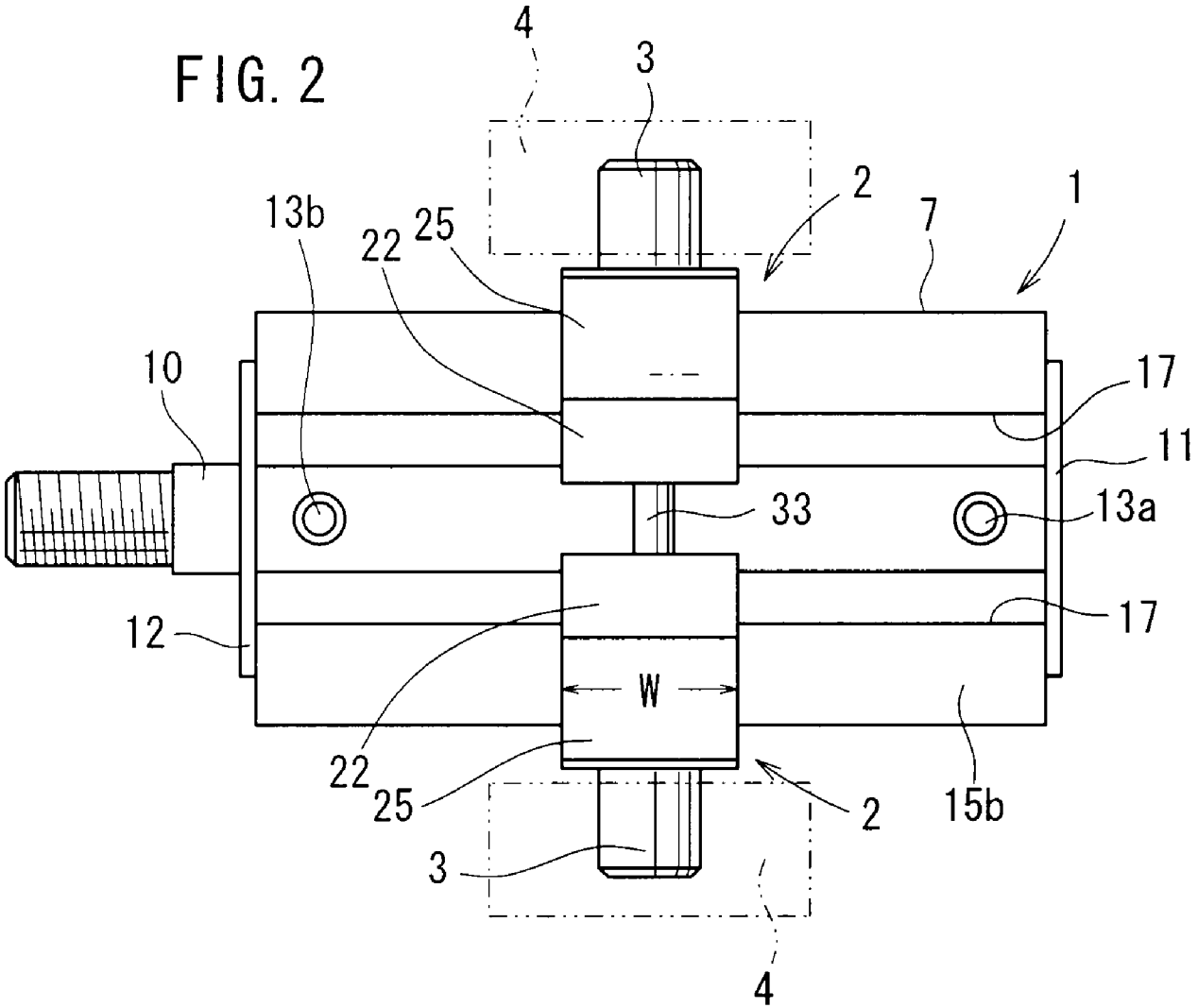
FIG. 2 is a plan view of the fluid pressure cylinder equipped with the trunnion support fitting shown in FIG. 1.
Figure 3:
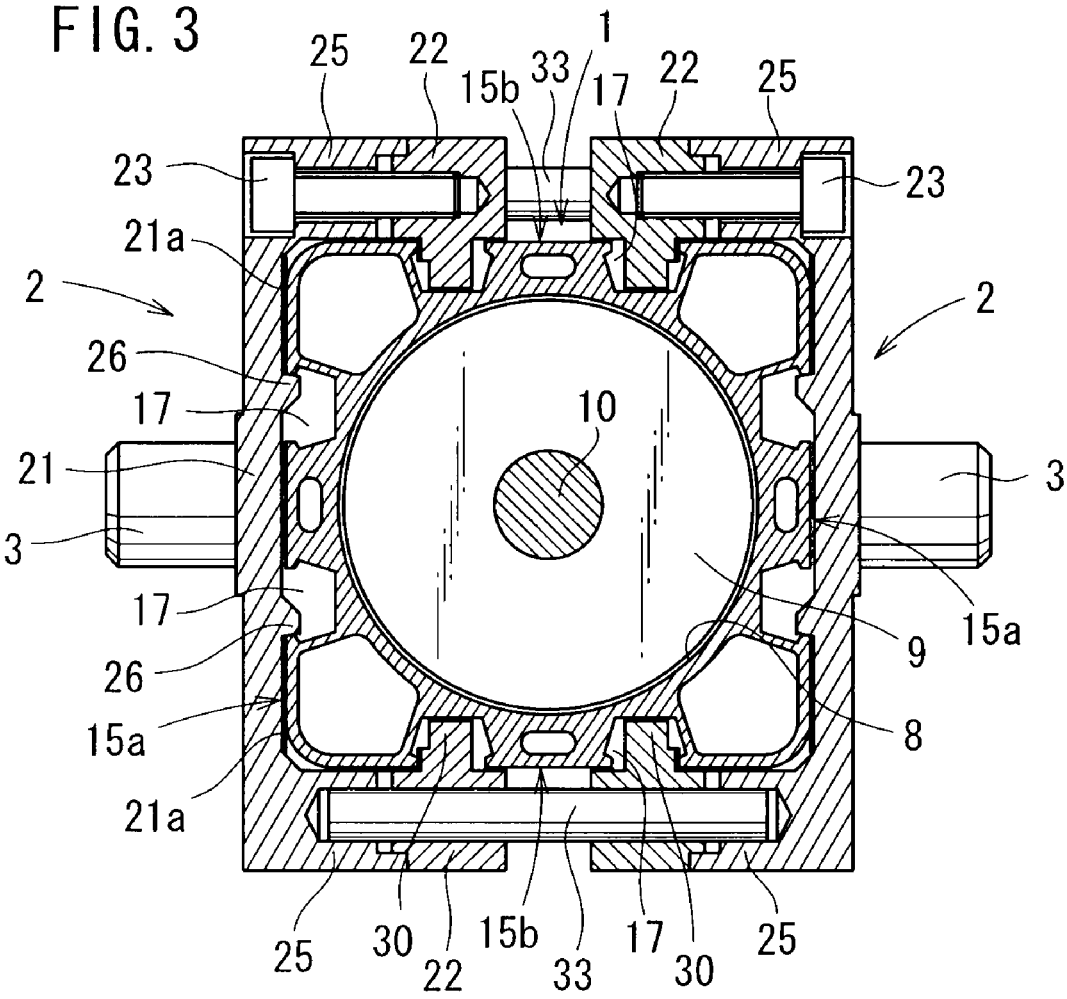
FIG. 3 is a cross sectional view taken along line III-III of FIG. 1.
Figure 4:
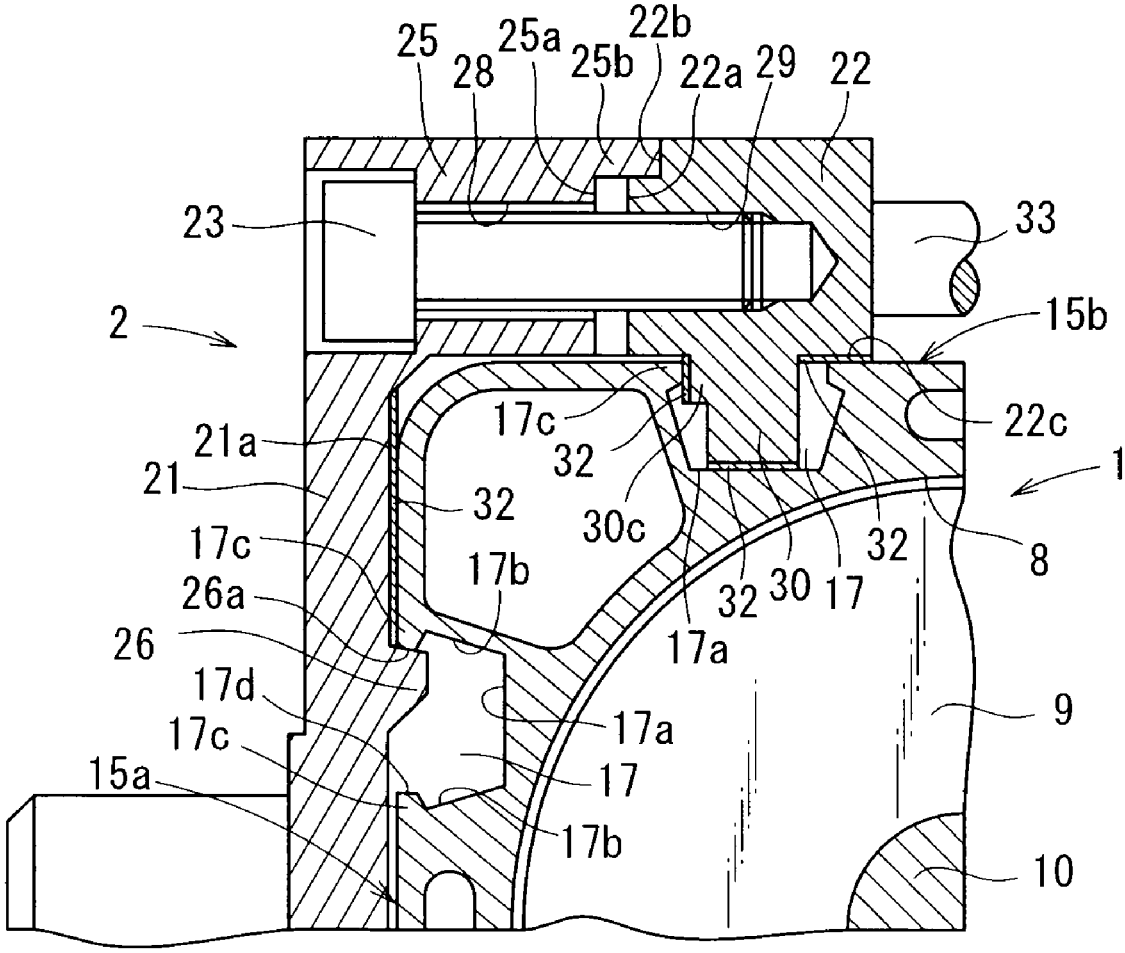
FIG. 4 is an enlarged view of essential parts of FIG. 3.
Figure 5:
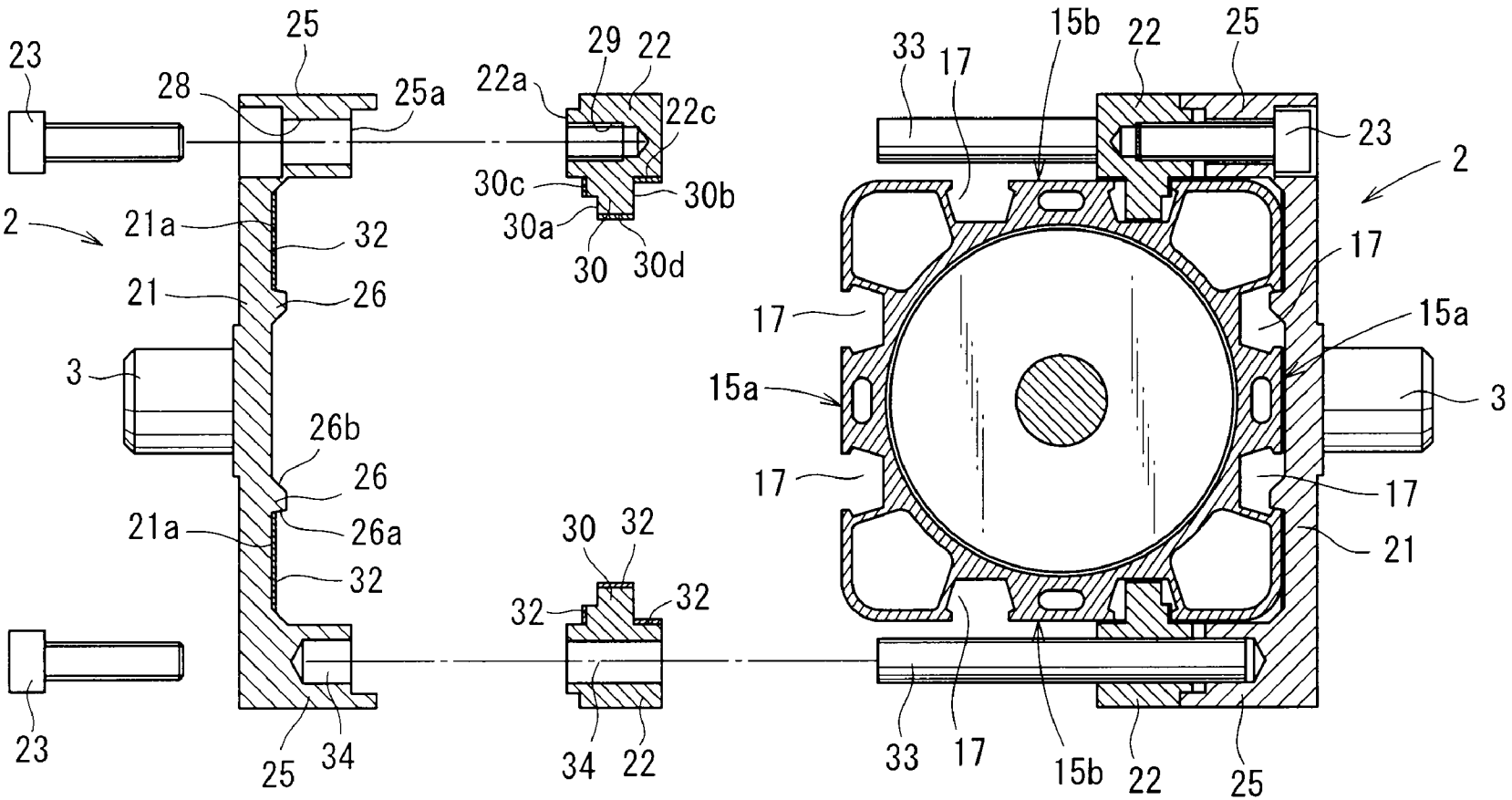
FIG. 5 is a partially exploded cross sectional view showing a condition in which one of the trunnion support fittings is detached from the fluid pressure cylinder shown in FIG. 3.

FIGS. 1 to 5 show a fluid pressure cylinder equipped with a trunnion support fitting according to a first embodiment of the present invention. Reference numeral 1 in the figures indicates the fluid pressure cylinder, whereas reference numeral 2 indicates trunnion support fittings, which are attached to the fluid pressure cylinder 1.

Figure 9:
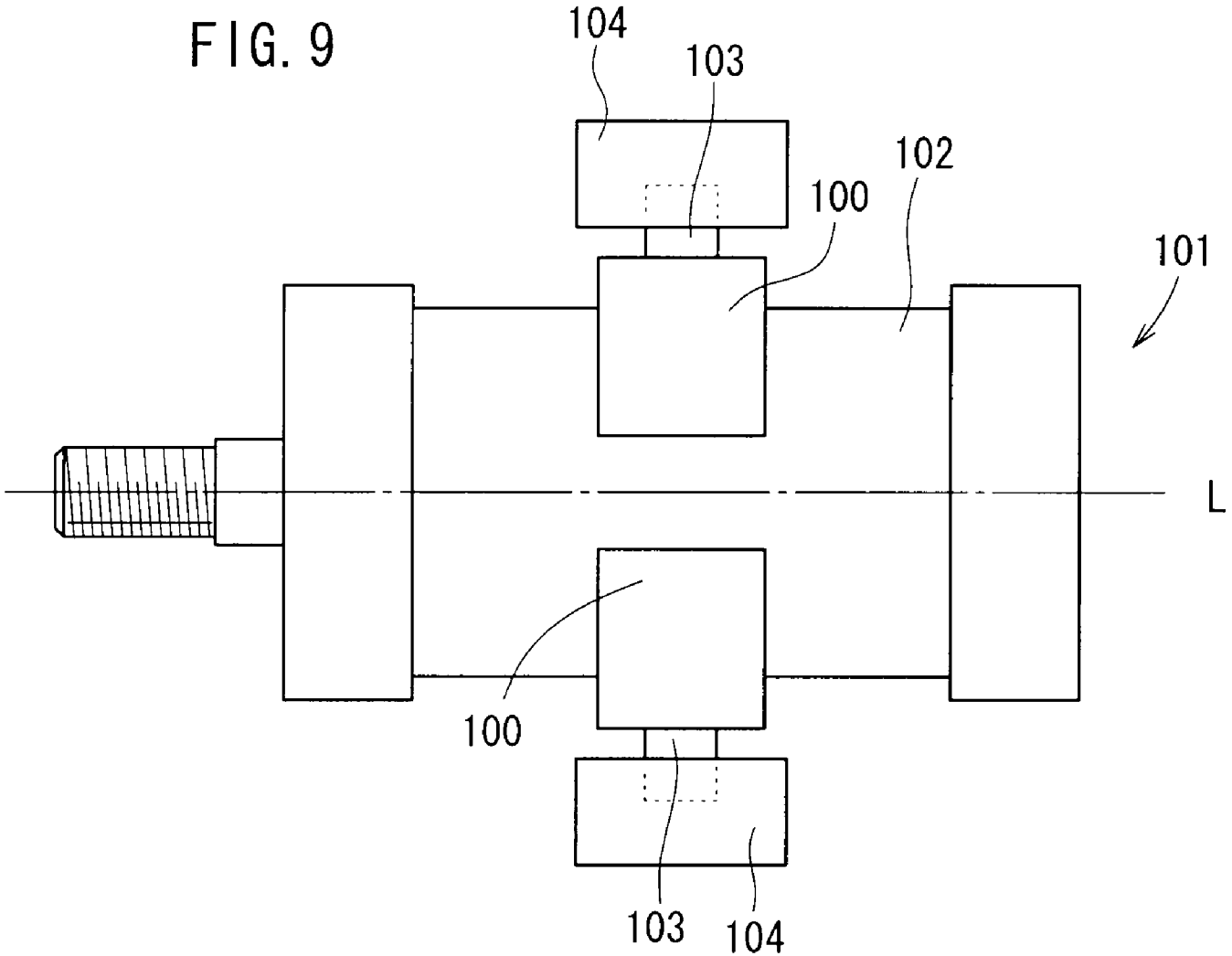
FIG. 9 is a plan view showing a conventional fluid pressure cylinder equipped with a trunnion support fitting.
Figure 10:
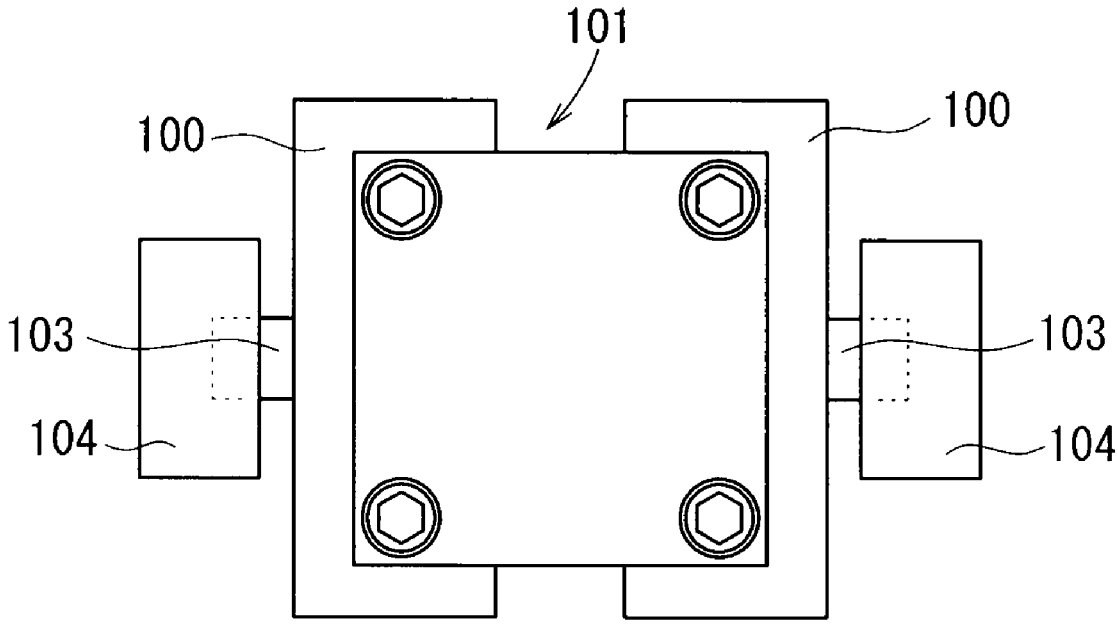
FIG. 10 is a side view of the fluid pressure cylinder equipped with the trunnion support fitting shown in FIG. 9.

The trunnion support fittings 2 are attached as a pair in a mutually confronting condition at opposite positions on an outer surface of the fluid pressure cylinder 1. The trunnion support fittings 2 each have respective support shafts 3. Similar to the conventional example shown in FIGS. 9 and 10, by means of the support shafts 3, which are positioned concentrically therewith, the trunnion support fittings 2 are supported swingably on bearing members 4 (see FIG. 2) in various types of industrial equipment. The pair of trunnion support fittings have mutually the same structure.

On the other hand, the fluid pressure cylinder 1 includes a cylinder tube 7 formed from a non-magnetic metal such as aluminum or the like and having a substantially rectangular shape in cross section. A cylinder bore 8 extending in an axial direction L of the cylinder tube 7 is formed inside the cylinder tube 7, and a piston 9 is disposed in a slidable fashion inside the cylinder bore 8. Both ends of the cylinder bore 8 are closed by a head cover 11 and a rod cover 12, and a piston rod 10, which extends from the piston 9 along the direction of the axis L, extends to the outside while passing through the rod cover 12 in an airtight manner.

Further, respective pressure chambers (not shown) are formed between the piston 9 and the head cover 11, and between the piston 9 and the rod cover 12. The pressure chambers are connected respectively to two ports 13*a*, 13*b* on the outer surface of the cylinder tube 7. Further, from the condition of FIG. 1, when a pressure fluid, such as air or the like, is supplied to the head side pressure chamber through the head side port 13*a*, the piston 9 moves (advances) toward the side of the rod cover 12, and the piston rod 10 extends. Conversely, when the pressure fluid is supplied to the rod side pressure chamber from the rod side port 13*b*, the piston 9 moves (retracts) toward the side of the head cover 11, and the piston rod 10 contracts.

The rectangular outer peripheral surface of the cylinder tube 7 is made up from two opposing parallel longitudinal outer surfaces 15*a*, 15*a* and another two opposing parallel lateral outer surfaces 15*b*, 15*b*. Two engagement grooves 17 extending in the direction of the axis L of the cylinder tube 7 are formed respectively on each of the longitudinal outer surfaces 15*a*, 15*a* and the lateral outer surfaces 15*b*, 15*b*. In the following descriptions, except when the longitudinal outer surfaces 15*a* and the lateral outer surfaces 15*b* are distinguished and indicated separately, they shall be indicated by the common reference numeral "15".

The engagement grooves 17 of each of the outer surfaces 15 are formed at symmetrical positions with respect to the center of the widthwise direction of the outer surfaces 15, and serve dually as attachment grooves for attachment of a position sensor (not shown), which is capable of detecting an operative position of the piston 9. Stated otherwise, such position sensor attachment grooves serve a dual purpose as the engagement grooves 17.

The groove walls of the engagement grooves 17 are made up from a flat bottom wall 17*a* (see FIG. 4) parallel to the outer surface 15, and left and right side walls 17*b*, 17*b*, which extend from the bottom wall 17*a* toward the side of the outer surface 15, while slanting in an outwardly expanded form. On ends thereof approaching the outer surface 15 on both side walls 17*b*, 17*b*, mutually opposing projecting wall portions 17*c* are formed, which project toward the inside of the engagement groove 17. The inner end surfaces 17*d* of the projecting wall portions 17*c* define surfaces that are perpendicular to the outer surface 15. Further, the interval (groove opening width) between the left and right projecting wall portions 17*c* is set to be the same or slightly wider than the width (groove bottom width) of the bottom wall 17*a*.

Each of the trunnion support fittings 2 has a roughly U-shape in cross section, and is constituted from a metallic main fitting 21 that abuts against one of the longitudinal outer surfaces 15*a* of the cylinder tube 7, and two metallic fastening fittings 22, which extend from both ends of the main fitting 21 respectively along the lateral outer surfaces 15*b*, 15*b*, extending to a position where one of the engagement grooves 17 formed in the lateral outer surfaces 15*b*, 15*b* is crossed over thereby. The end of the fastening fitting 22 does not reach the center of the lateral outer surfaces 15*b*, but is arranged at a position short of the center. The main fitting 21 and the two fastening fittings 22, 22 are formed separately from each other, and as described later, are connected together mutually by screws 23.

The main fitting 21 crosses over the longitudinal outer surface 15*a* in a widthwise direction, such that both ends thereof project beyond both sides of the longitudinal outer surface 15*a*. Connection arm sections 25, 25, which extend to positions in front of the engagement grooves 17 along the lateral outer surfaces 15*b*, 15*b*, are formed on both ends of the main fitting 21. The width W (see FIG. 2) of the main fitting 21 is formed sufficiently small compared to the length of the axial direction L of the cylinder tube 7. The attachment position of the main fitting 21 is capable of being adjusted in the axial direction L.

Further, a support shaft 3 extends in a direction perpendicular to the axis L of the cylinder tube 7, at a central position on the outer surface of the main fitting 21. Two positioning projections 26, 26, which extend in parallel roughly perpendicular to the lengthwise direction of the main fitting 21, are formed symmetrically with respect to the center of the main fitting 21 on the inside surface of the main fitting 21. The positioning projections 26 have a projection width that is narrower than the opening width of the engagement grooves 17, and both left and right side walls 26*a*, 26*b* thereof are formed as inclined walls, which are slanted in a gradually tapering form. In addition, the angles of inclination of both left and right side walls 26*a*, 26*b* are different from each other. Each of the steeply inclined side walls 26*a*, which are positioned outwardly with respect to the center of the main fitting 21, abuts and engages in a one-sided manner with respect to the projecting wall portion 17*c* of one of the side walls 17*b* in the engagement groove 17, i.e., with respect to the projecting wall portion 17*c* of the outer side wall 17*b* which is positioned toward the side of the longitudinal outer surface 15*a*.

Owing thereto, the trunnion support fitting 2 is positioned at the center of the longitudinal outer surface 15*a*. At this time, the surface portions 21*a*, 21*a* of the inside surface of the main fitting 21 positioned outwardly from the two positioning projections 26, 26, are made to abut with respect to the longitudinal outer surface 15*a*.

A joint surface 25*a* to which the fastening fitting 22 is connected is formed on the distal end of each arm section 25. Two parallel screw attachment holes 28, 28, which extend from the outer side surface of the main fitting 21 to the joint surface 25*a*, are formed inside the arm section 25. In addition, a base end 22*a* of the fastening fitting 22 is made to abut against the joint surface 25*a*, such that by screw-engagement of screws 23 that are inserted through the screw attachment holes 28 into screw holes 29 of the fastening fitting 22, the fastening fitting 22 is connected and affixed to the main fitting 21. In this case, mutually interfitting projections 25*b* and recesses 22*b* preferably are formed on the joint surface 25*a* of the arm section 25 and the base end 22*a* of the fastening fitting 22.

Attachment projections 30, which extend along the engagement grooves 17 over which the fastening fittings 22 extend, are formed over the total width of the fastening fittings 22, on inner side surfaces of the fastening fittings 22 that abut against the lateral outer surfaces 15*b*. The attachment projections 30 have a projection width, which is narrower than the groove opening width of the engagement grooves 17, and a projection height reaching to the bottom wall 17*a*. Among both left and right side walls 30*a*, 30*b* of the attachment projections 30, an outwardly expanded portion 30*c* is formed on a part of the side wall 30*a* which is positioned on the side of the main fitting 21. In addition, the expanded portion 30*c* is engaged by abutting in a one-sided manner against the projecting wall portion 17*c* of one of the side walls 17*b* in the engagement groove 17, such that by engagement of the attachment projections 30 in the engagement grooves 17, the trunnion support fitting 2 is mounted onto the outer surface of the cylinder tube 7. In this case, the latching force of the attachment projections 30 can be adjusted by tightening the screws 23, and by loosening the screws 23, the trunnion support fitting 2 can be moved along the engagement grooves 17 so that the attachment position thereof can be changed.

In a condition where the trunnion support fittings 2 are mounted on the cylinder tube 7, the distal end surfaces 30*d* of the attachment projections 30 abut against the bottom wall 17*a* of the engagement grooves 17. Further, among the inner surfaces of the fastening fitting 22, the surface portion 22*c* disposed outwardly from the attachment projection 30 abuts against the lateral outer surface 15*b*.

Further, on the trunnion support fitting 2, a particle layer 32 for enhancing friction between the trunnion support fitting 2 and the cylinder tube 7 is formed on portions thereof that abut against the cylinder tube 7. In the first embodiment, the particle layer 32 is formed respectively on the surface portion 21*a* that abuts against the longitudinal outer surface 15*a* of the main fitting 21, on the surface portion 22*c* of the inner surface of the fastening fitting 22 that abuts against the lateral outer surface 15*b*, on the distal end surface 30*d* of the attachment projection 30 that abuts against the bottom wall 17*a* of the engagement groove 17, and on a surface of the expanded portion 30*c* on the side wall 30*a* of the attachment projection 30, which abuts against the projecting wall portion 17*c* of the engagement groove 17.

The particle layer 32 can be obtained by depositing (sand coating) hard particles, for example, diamond abrasive grains, silicon carbide grains or the like, at each of the aforementioned portions, using an electrodeposition method, an adhesive bonding method or the like. At this time, the particle diameter of each of such grains, for example, preferably is on the order of F100 to F180, with F150 being particularly preferable. However, other particle diameters apart from those mentioned may also be used.

Additionally, in the case that the grains are affixed using an adhesive, it is preferable for an adhesive having a low hardness characteristic to be used. The reason therefor is that, due to the fact that such a low hardness property adhesive becomes pressed flat when sandwiched and pressed between substances, the grains tend to rise easily toward the surface of the adhesive layer.

In this manner, by forming the particle layer 32 on the trunnion support fitting 2, because friction thereof with respect to the cylinder tube 7 increases, even if the trunnion support fitting 2 is not tightened so firmly by the screws 23, the trunnion support fitting 2 still is affixed with a large fastening force (frictional force) with respect to the cylinder tube 7.

Accordingly, the attached condition of the trunnion support fitting 2 is stabilized, and shifting in position due to vibrations or the like accompanying swinging movements of the fluid pressure cylinder 1 does not occur. Further, since it is not necessary for the screws 23 to be strongly tightened and cause the attachment projections 30 of the fastening fitting 22 to abut against and be fastened with a strong force in the engagement grooves 17 of the cylinder tube 7, even if the cylinder tube 7 is formed from a comparatively soft metal such as aluminum, warping and deformation of the cylinder tube 7 does not occur.

It is not necessary that the particle layer 32 be formed at all of the above-mentioned portions, and it is acceptable if the particle layer 32 is formed on at least one of these portions. For example, the particle layer 32 can be formed on either or both of the surface portion 21*a* of the main fitting 21 and the surface of the expanded portion 30*c* of the attachment projection 30. Alternatively, the particle layer 32 may be formed on portions apart from those discussed above, which come into abutment against the cylinder tube 7.

By stretching respective positioning pins 33 between both end portions of the pair of trunnion support fittings 2, 2, the trunnion support fittings 2, 2 are reliably positioned in mutually opposing positions. More specifically, pin insertion holes 34 are formed so as to penetrate through the fastening fittings 22 at positions between the two screw holes 29, 29 in the fastening fittings 22, at both ends of each of the trunnion support fittings 2, with ends of the pin insertion holes 34 reaching to an intermediate portion of the arm sections 25. In addition, by inserting both ends of the position pins 33 inside of the pin insertion holes 34, the trunnion support fittings 2, 2 are positioned relatively to each other.

When the operative position of the piston 9 in the fluid pressure cylinder 1 is detected, a position sensor (not shown) is mounted into any one of the engagement grooves 17 formed on the outer surface 15 of the cylinder tube 7. For example, a magnetic sensor that detects a permanent magnet mounted on the piston 9 can be used. However, position sensors of this type are well known, and therefore details of the position sensor have not been illustrated.

In this manner, in the case that the engagement grooves 17 for attachment of the trunnion support fittings 2 are used dually as attachment grooves for attachment of the position sensor, it is not necessary to form the engagement grooves 17 separately and apart from the sensor attachment grooves. Owing thereto, the fluid pressure cylinder 1 can be made with an extremely simple and rational design structure, and in the case that the fluid pressure cylinder 1 already has sensor attachment grooves formed therein, the trunnion support fittings 2 can be attached as is to the fluid pressure cylinder 1. Naturally, the engagement grooves 17 may also be formed separately from the sensor attachment grooves.

Figure 6:
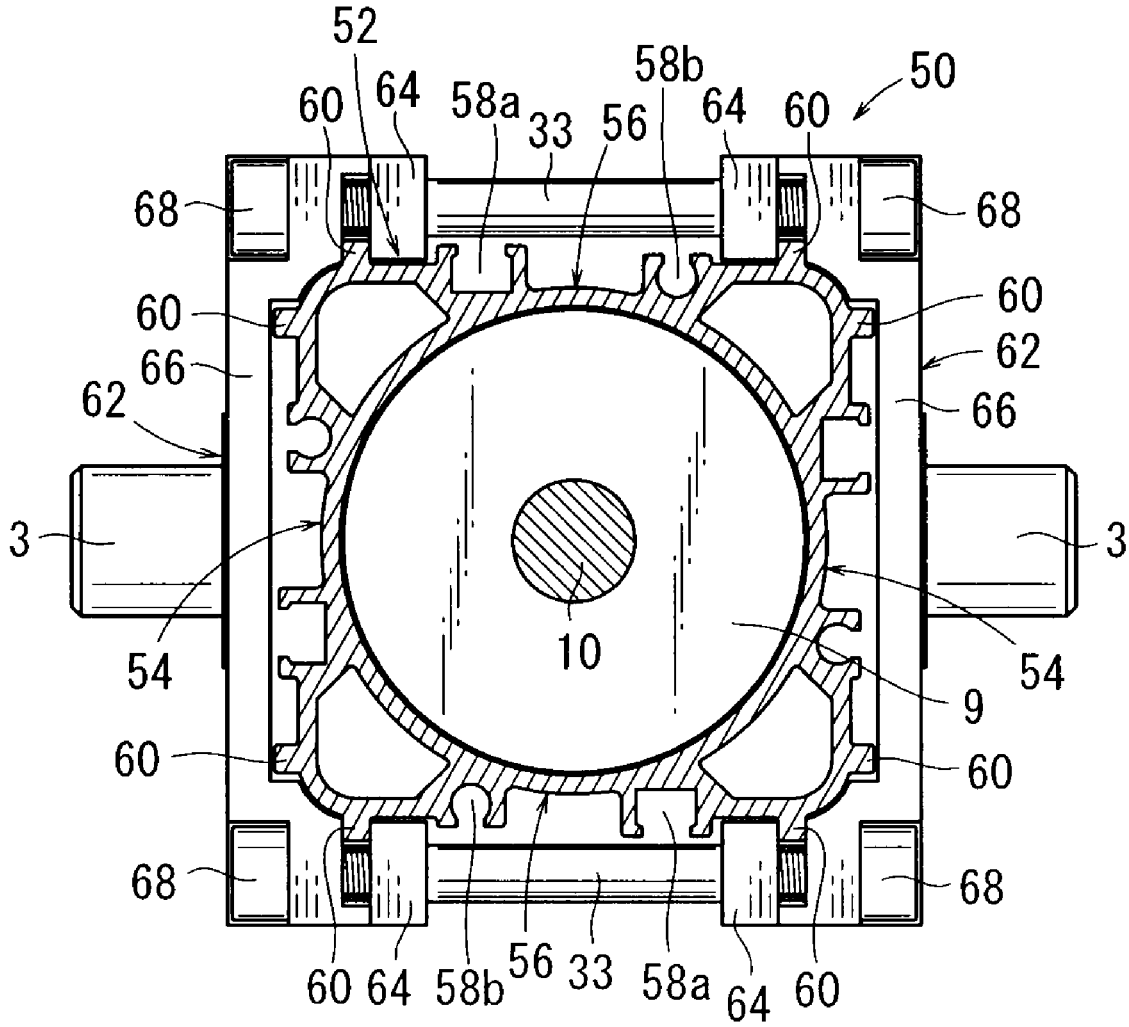
FIG. 6 is a partial cross sectional frontal view showing a fluid pressure cylinder equipped with a trunnion support fitting according to a second embodiment of the present invention.
Figure 7:
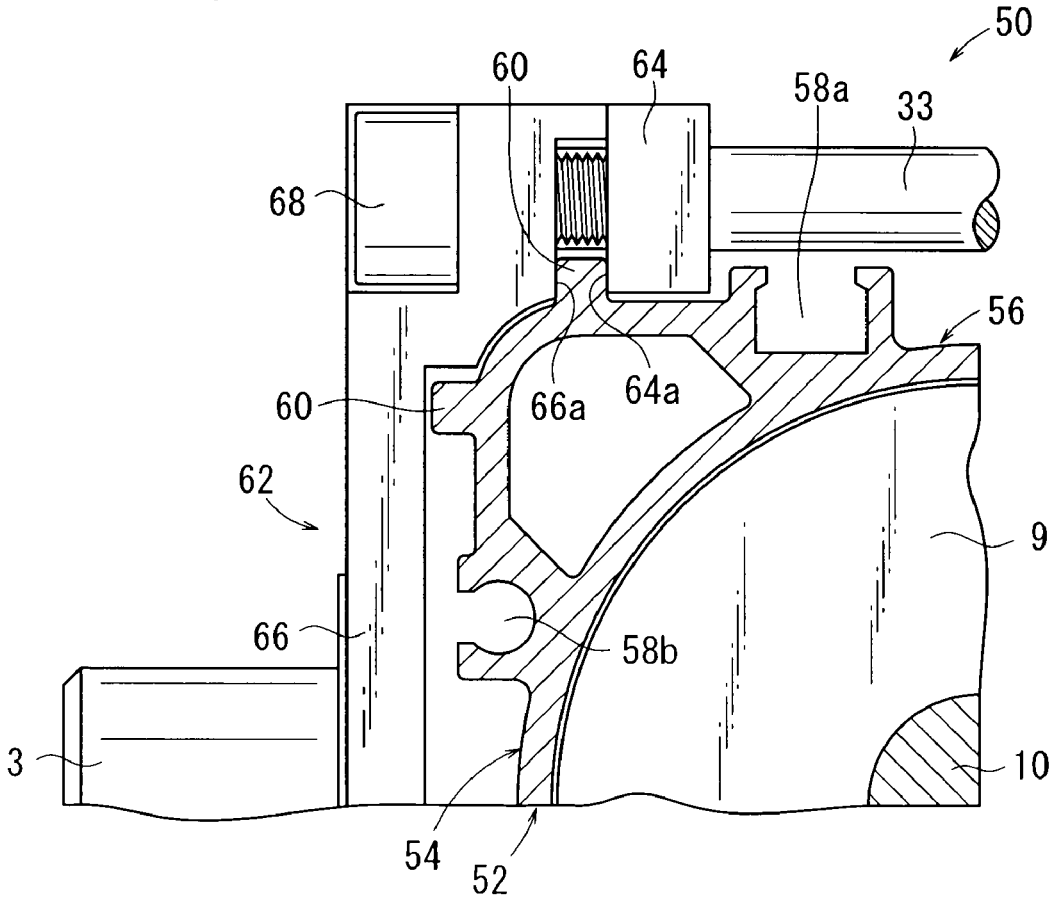
FIG. 7 is an enlarged view of essential parts of FIG. 6.
Figure 8:
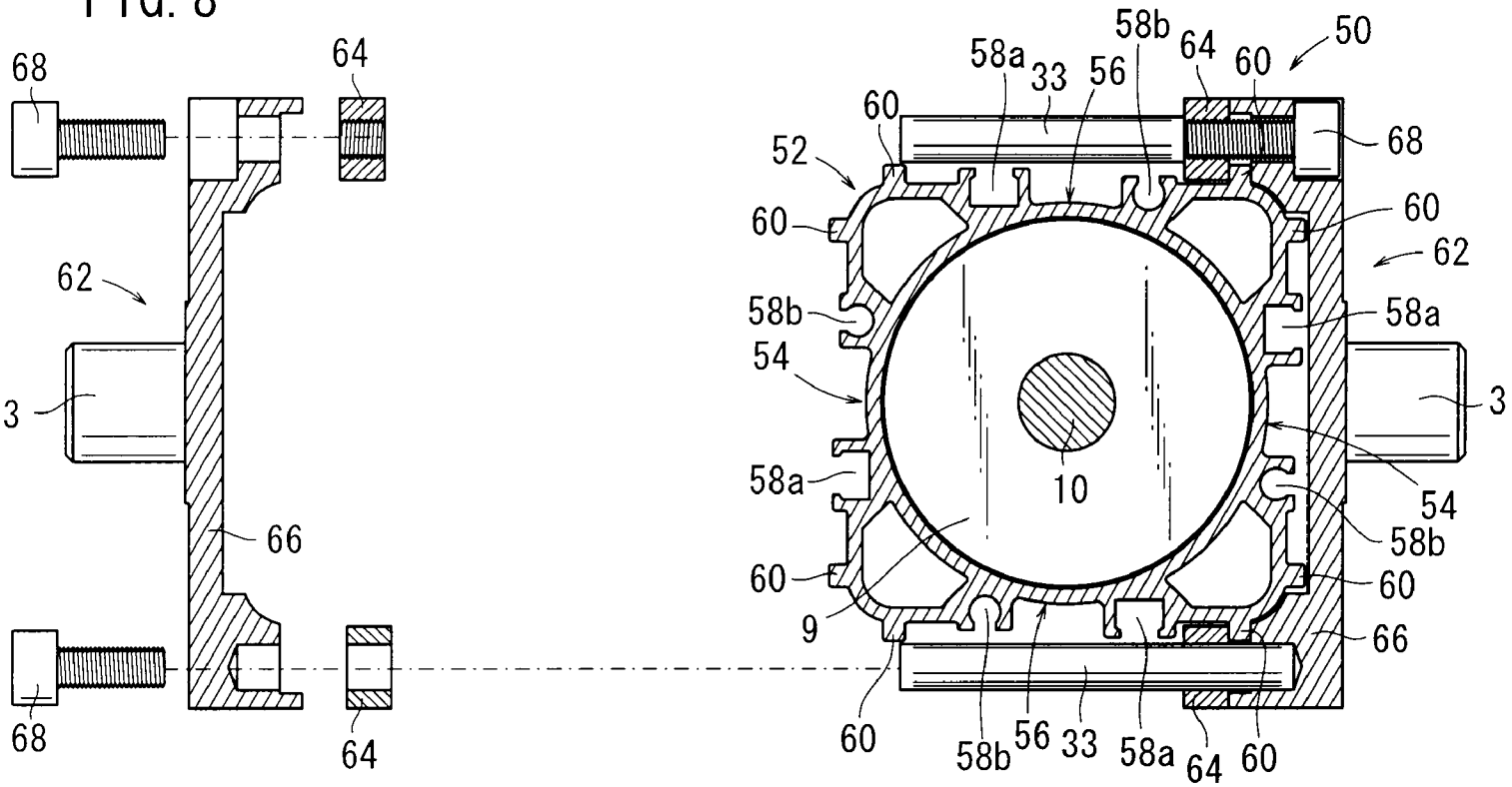
FIG. 8 is a partially exploded cross sectional view showing a condition in which one of the trunnion support fittings is detached from the fluid pressure cylinder shown in FIG. 6.

Next, a fluid pressure cylinder 50 equipped with a trunnion support fitting according to a second embodiment is shown in FIGS. 6 to 8. Structural elements thereof, which are the same as those of the fluid pressure cylinder 1 equipped with the trunnion support fitting according to the aforementioned first embodiment, are designated using the same reference characters, and detailed descriptions of such features have been omitted.

The fluid pressure cylinder 50 on which the trunnion support fittings according to the second embodiment are installed differs from the fluid pressure cylinder 1 on which the trunnion support fittings 2 according to the first embodiment are installed, in that pairs of flanges 60 are disposed respectively on the longitudinal outer surfaces 54 and lateral outer surfaces 56 of the cylinder tube 52, on outer sides of sensor attachment grooves 58*a*, 58*b*, and the trunnion support fittings 62 are installed via the flanges 60.

The flanges 60 are formed with rectangular shapes in cross section and are disposed in pairs so as to project at a predetermined height with respect to each of the longitudinal outer surfaces 54 and lateral outer surfaces 56 of the cylinder tube 52, while extending along the axial direction of the cylinder tube 52. Further, the sensor attachment grooves 58*a*, 58*b*, which are provided on the longitudinal outer surfaces 54 and the lateral outer surfaces 56, are disposed in parallel and separated mutually by a predetermined distance, the sensor attachment grooves 58*a*, 58*b* being formed with different cross sectional shapes respectively. More specifically, one of the sensor attachment grooves 58*a* is formed with a substantially rectangular shape in cross section, whereas another of the sensor attachment grooves 58*b* is formed as a round groove with a roughly semicircular shape in cross section. However, the cross sectional shapes of the two sensor attachment grooves 58*a*, 58*b* are not restricted to the cases of the aforementioned rectangular and semicircular cross sectional shapes.

Fastening fittings 64 constituting parts of the trunnion support fittings 62 are disposed on inner sides of the flanges 60, whereas the main fittings 66 making up the trunnion support fittings 62 are disposed on outer sides of the flanges 60. Screws 68 are inserted through the main fittings 66 and the fastening fittings 64, and the screws 68 are screw-engaged with respect to the fastening fittings 64. By means thereof, the main fittings 66 and the fastening fittings 64 are connected mutually to each other through the screws 68, whereby the flanges 60 are sandwiched and retained between side walls 66*a* of the main fittings 66 and side walls 64*a* of the fastening fittings 64 (see FIG. 7).

In this manner, according to the second embodiment, pairs of flanges 60 are disposed respectively on the longitudinal outer surfaces 54 and the lateral outer surfaces 56 of the cylinder tube 52 constituting the fluid pressure cylinder 50. By sandwiching the flanges 60 between the main fittings 66 and the fastening fittings 64 that make up the trunnion support fittings 62, a structure capable of retaining the trunnion support fittings 62 is provided. Owing thereto, when the flanges 60 are gripped by the main fittings 66 and the fastening fittings 64 upon tightening the screws 68, tightening forces of the screws 68 are imparted only to the flanges 60, while the tightening forces are applied in mutually opposing directions from the main fittings 66 and the fastening fittings 64 centrally about the flanges 60. That is, deformation of the cylinder tube 52 having the flanges 60 by means of such tightening forces is prevented.

In greater detail, because the main fittings 66 and the fastening fittings 64 are displaced in directions to approach mutually toward each other centrally about the flanges 60, the forces therefrom cancel each other out, and forces tending to deform the flanges are not imparted. As a result, even in the event that the trunnion support fittings 62 are attached to the fluid pressure cylinder 50, displacement of the piston 9 disposed inside of the cylinder tube 52 is not disturbed, thereby enabling the piston 9 to be displaced smoothly.

Further, because the trunnion support fittings 62 are installed onto the cylinder tube 52 via the flanges 60, the trunnion support fittings 62 can be reliably and easily installed with respect to the fluid pressure cylinder 50, without regard to the configuration or shape of the sensor attachment grooves 58*a*, 58*b* provided on the cylinder tube 52. Stated otherwise, trunnion support fittings 62 of the same shape can be installed without depending on the configuration and shape of the sensor attachment grooves 58*a*, 58*b* formed on the cylinder tube 52, and together therewith, since it is unnecessary to respectively prepare various different types of trunnion support fittings corresponding to shapes of the sensor attachment grooves 58*a*, 58*b*, the number of parts is decreased and manufacturing costs can be reduced.

The invention claimed is:

1. A fluid pressure cylinder equipped with a trunnion support fitting, wherein a piston disposed inside a cylinder tube is displaced upon supply of a pressure fluid thereto, and comprising:

a pair of trunnion support fittings disposed on an outer surface of the cylinder tube swingably supporting the fluid pressure cylinder on bearing members, each of the trunnion support fittings including attachment projections, which engage in engagement grooves formed on the outer surface of the cylinder tube, and a particle layer enhancing friction formed at a region that abuts with the outer surface of the cylinder tube, wherein by engagement of the attachment projection into the engagement groove, the trunnion support fittings are mounted with respect to the cylinder tube, in a state such that the particle layer abuts against the outer surface of the cylinder tube, and the particle layer grips the outer surface of the cylindrical tube so that the cylindrical tube is not deformed by a compression force of the pair of trunnion support fittings against the outer surface of the cylinder tube.

2. The fluid pressure cylinder according to claim 1, wherein the particle layer is formed respectively on inner surfaces of the trunnion support fittings that abut against the outer surface of the cylinder tube, and on the attachment projections that abut against groove walls of the engagement grooves.

3. The fluid pressure cylinder according to claim 1, wherein the cylinder tube is formed with a substantially rectangular shape in cross section, having two opposing longitudinal outer surfaces and two other opposing lateral outer surfaces, and further having two of the engagement grooves extending in the axial direction of the cylinder tube, provided respectively on each of the longitudinal outer surfaces and the lateral outer surfaces.

4. The fluid pressure cylinder according to claim 3, wherein each of the trunnion support fittings includes:

a pair of main fittings, each of which is formed with a substantially U-shape in cross section, mounted along and abutted against the longitudinal outer surfaces of the cylinder tube, and wherein both end portions thereof extend respectively along the lateral outer surfaces; and a pair of fastening fittings provided on the both end portions of the main fittings, which are disposed so as to confront the engagement grooves provided on the lateral outer surfaces, wherein two positioning projections, which are engaged in the two engagement grooves formed on the longitudinal outer surfaces, are formed on the main fittings, and the attachment projections, which are engaged within the engagement grooves of the lateral outer surfaces, are formed on the fastening fittings, the pair of trunnion support fittings being attached at mutually confronting positions of the cylinder tube.

5. The fluid pressure cylinder according to claim 4, wherein the particle layer on the inner surfaces of the trunnion support fitting is formed on both of the main fittings and the fastening fittings.

6. The fluid pressure cylinder according to claim 4, wherein the fastening fittings are formed apart from the main fittings, and are connected with respect to the main fittings by screws, the attachment projections becoming latched in the engagement grooves by tightening the screws.

7. The fluid pressure cylinder according to claim 1, wherein a positioning pin is stretched between one of the trunnion support fittings and another of the trunnion support fittings, such that the one trunnion support fitting and the other trunnion support fitting are mutually relatively positioned by the positioning pin.

8. A fluid pressure cylinder equipped with a trunnion support fitting, wherein a piston disposed inside a cylinder tube is displaced upon supply of a pressure fluid thereto, and comprising:

trunnion support fittings disposed on an outer surface of the cylinder tube swingably supporting the fluid pressure cylinder on bearing members, the trunnion support fittings including:

a pair of main fittings, each of which is formed with a substantially U-shape in cross section, mounted on longitudinal outer surfaces of the cylinder tube, and wherein both end portions thereof are disposed outwardly of flanges, which are formed on lateral outer surfaces of the cylinder tube;

a pair of fastening fittings provided on the both end portions of the main fittings, and which are disposed inwardly of the flanges; and screws that connect the main fittings and the fastening fittings, wherein the main fittings and the fastening fittings are linearly displaceable toward each other to sandwich the flanges therebetween, the flanges being gripped by tightening the screws.

9. The fluid pressure cylinder according to claim 8, wherein the flanges are provided in respective pairs on each of longitudinal outer surfaces and on other opposing lateral outer surfaces of the cylinder tube, which is formed with a substantially rectangular shape in cross section, the flanges being formed so as to project outwardly with respect to the longitudinal outer surfaces and the lateral outer surfaces.

10. The fluid pressure cylinder according to claim 8, wherein the flanges are disposed at positions outwardly with respect to an attachment groove of the cylinder tube in which a detection sensor capable of detecting a displacement position of the piston is installed.

* * * * *